United States Patent [19]

Villanueva et al.

[11] Patent Number: 4,541,598

[45] Date of Patent: Sep. 17, 1985

[54] HANGER FOR MOUNTING ITEMS

[75] Inventors: Jesus R. Villanueva, Justice; Richard G. Krautsack, Arlington Heights, both of Ill.

[73] Assignee: The Cooperative Marketing Co., Elk Grove Village, Ill.

[21] Appl. No.: 520,717

[22] Filed: Aug. 5, 1983

[51] Int. Cl.[4] ..... G09F 3/18

[52] U.S. Cl. ..... 248/221.4; 40/11 R

[58] Field of Search ..... 248/221.4, 223.4, 224.2, 248/73; 211/54.1, 57.1; 40/16, 16.2, 16.4, 11 R

[56] References Cited

U.S. PATENT DOCUMENTS

| | | | |
|---|---|---|---|
| 597,230 | 1/1898 | Weston | 211/54.1 |
| 2,925,239 | 2/1960 | Luck | 40/16 |
| 3,530,605 | 9/1970 | Gutterson | 40/11 R |
| 3,779,496 | 12/1973 | Welles | 248/99 |
| 4,059,190 | 11/1977 | Conway | 211/57.1 |
| 4,090,415 | 6/1978 | Larson | 211/57.1 |
| 4,179,138 | 12/1979 | Bogdanovic | 248/221.4 |
| 4,373,693 | 2/1983 | Greenberger | 248/221.4 |

FOREIGN PATENT DOCUMENTS

| | | | |
|---|---|---|---|
| 2653809 | 2/1977 | Fed. Rep. of Germany | 248/221.4 |

*Primary Examiner*—Reinaldo P. Machado
*Assistant Examiner*—Alvin Chin-Shue
*Attorney, Agent, or Firm*—Fitch, Even, Tabin & Flannery

[57] ABSTRACT

A hanger for supporting a plurality of generally flat items, such as a pad of coupons, each of which has a mounting pole. The hanger is integral and formed of a generally flat resilient blank made of an extruded organic polymeric resin. The hanger comprises a head portion for mounting on a support structure, a lower portion for carrying the items and a stem interconnecting the head portion and the lower portion. The lower portion includes a pair of oppositely extending arms having adjacent connected ends and remote distal ends. The arms are deflectable from the plane of the blank together to form a shaft for projecting through the mounting holes in the items. The distal end of each arm has one oppositely extending barb-like projection for retaining the items on the shaft.

7 Claims, 10 Drawing Figures

HANGER FOR MOUNTING ITEMS

BACKGROUND OF THE INVENTION

The present invention relates to supports and, more particularly, to a plastic hanger for mounting generally flat items (such as coupons) from a channel.

It is a common practice for retail establishments such as supermarkets and drugstores to distribute manufacturers' promotional coupons and the like. Experience has shown that a particularly effective distribution point of tear off coupons is at the shelf location of the product being promoted. Various types of clips and hangers are available for supporting a pad of coupons from a shelf or a wall. While such devices and hangers are satisfactory, some of them are difficult to install on the shelf. Others are suitable for use with only a single pad of coupons, while others are of relatively expensive molded or multiple piece construction. For further details regarding the operation and structure of such prior art devices, reference may be made to U.S. Pat. Nos. 3,899,841; 4,016,977; 4,059,190; and 4,179,138.

SUMMARY OF THE INVENTION

Among the several objects of the present invention may be noted the provision of an improved hanger for supporting tear off coupons; the provision of such hanger which could be reusable so that the time and expense of mounting a new hanger for each pad of coupons might be avoided; the provision of such hanger which is fast and simple to mount and which permits fast and easy mounting of a pad of coupons; and the provision of such hanger which is reliable, has long service life and is simple and economical to manufacture. Other features and objects will be in part apparent and in part pointed out hereinafter in the specification and attendant claims.

Briefly, the hanger of the present invention comprises a head portion for mounting on a support structure, a lower portion for carrying the items and a stem interconnecting the head portion and the lower portion. The lower portion includes a pair of oppositely extending arms having adjacent connected ends and remote distal ends. The arms are deflectable so that they may be brought together to form a shaft for projecting through mounting holes in the items. The distal ends of the arms have an oppositely extending barb-like projections for retaining the items on the shaft.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
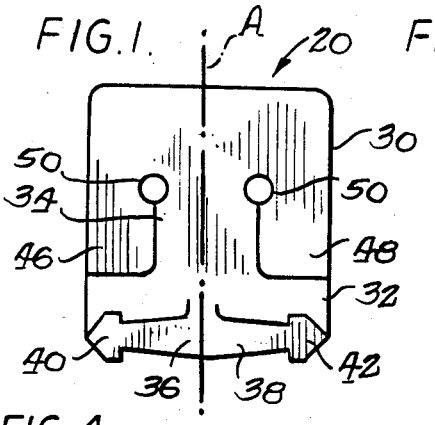
FIG. 1 is a front elevational view of a mounting hanger of the type of the present invention.
Figure 2:
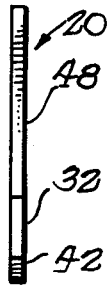
FIG. 2 is a side elevational view of the hanger of FIG. 1.

Referring now to the drawings, a hanger for mounting a plurality of generally flat items, each of which has a mounting hole, such as a stack of coupons 66 in pad form, from a channel 22 (shown in phantom in FIG. 3), is generally indicated in FIGS. 1–4 by reference numeral 20. Hanger 20 is integral and is preferably formed from a generally flat, resilient blank made of an extruded organic polymeric resin, such as polythylene or polyvinyl chloride. The hanger is useful not only for mounting coupons, but can carry other types of flat items for distribution on a one at a time basis, such as order blanks, advertising and recipes. Besides single sheets, hanger 20 can mount folded sheets and even thin booklets. Channel 22 represents the horizontally extending channel affixed to the forward edge of a shelf for merchandise, the primary function of which is to hold cards with pricing information. Channel 22 includes an upper flange 24, a lower flange 26 and a web 28 extending therebetween. The hanger 20 is formed from the blank by, preferably, impressing it with a die which simultaneously makes a plurality of cuts for defining various components and punches a plurality of holes which reduce stresses in the material and also allows mounting upon a wire basket of a supermarket cart or the like.

Figure 3:
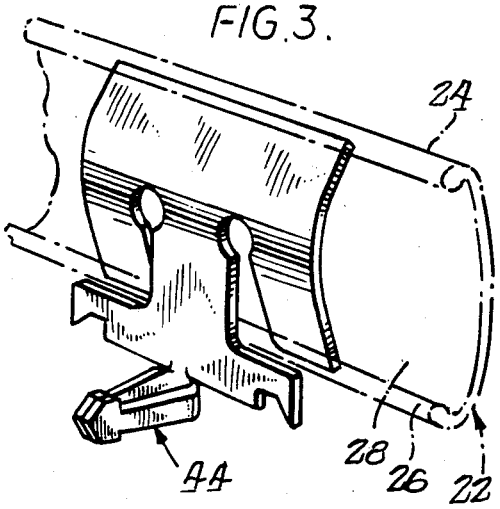
FIG. 3 is a perspective view of the hanger mounted in a channel extending horizontally.
Figure 4:
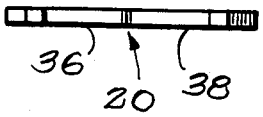
FIG. 4 is a bottom view of the hanger of FIG. 1.

Hanger 20 comprises a head portion 30 for mounting in channel 22, a lower portion 32 for carrying the items, and a stem 34 interconnecting head portion 30 and a lower portion 32. The lower portion has, in its as-formed condition, a pair of oppositely extending horizontal arms 36, 38 having adjacent connected ends and remote distal ends 40, 42, respectively, each in the general shape of an arrowhead. Arms 36, 38 are deflectable from the plane of the blank so that they can be brought together, as shown in FIG. 3, to form a shaft 44 for projecting through the mounting holes of the items. As shown in FIG. 1, hanger 20 is generally symmetrical about a plane A intersecting the hanger and extending between arms 36, 38.

Head portion 30 includes a pair of spaced dependent legs 46, 48, flanking stem 34, for engaging lower channel flange 26. Apertures 50 are provided at the junctions of the upper portions of the legs with the stem to avoid the formation of localized stress concentrations which could cause tearing of the hanger during the bending of the various components attendant positioning of the hanger in the channel. The proportioning is such that the apertures 50 will accommodate the usual diameter wire that is used in constructing the baskets of supermarket carts or the like. It will also be appreciated that the hanger can be mounted at an edge of a corrugated box by pushing the hanger downwardly with the edge disposed between stem 34 and legs 46, 48.

Operation of hanger 20 is as follows: The operator bows head portion 30 until it fits into the web 28 of channel 22. Upon release, the head portion, due to its resiliency and slightly greater height than web 28, will attempt to straighten causing legs 46, 48 to engage lower flange 26 and the top of the head portion to engage upper flange 24 thereby securely holding the hanger in compression in the channel. Arms 36, 38 are brought together to form shaft 44 and the mounting holes of the items to be distributed are brought into alignment with the shaft. Mounting of the items is effected by simply pushing them onto the shaft past the arrowheads which prevent retrograde movement of the items once mounted. After all of the items are removed, typically individually by a downward pull causing ripping or displacement of that portion of the item above the shaft, another group of items can be mounted, if desired.

Figure 5:
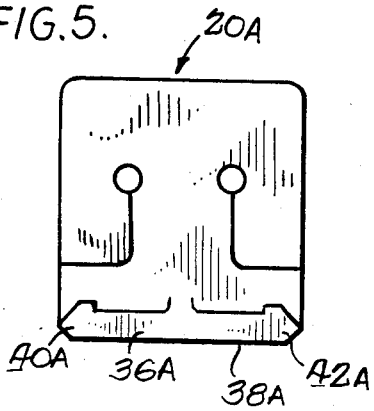
FIGS. 5 and 6 are a front elevational view and a side elevational view of an alternate embodiment of a hanger similar to that shown in FIG. 1.
Figure 6:
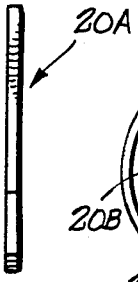

Referring to FIGS. 5 and 6, an alternate embodiment of the present invention is generally indicated by reference character 20A. Components of hanger 20A corresponding to components of hanger 20 are indicated by the reference numeral assigned to the component of hanger 20 with the addition of the suffix "A". The structure and operation of hanger 20A are substantially identical to that previously described with respect to hanger 20 except that the distal ends 40A, 42A of the arms 36A, 38A, respectively, do not have full arrowheads. Instead each end has only an upper projection.

Figure 9:
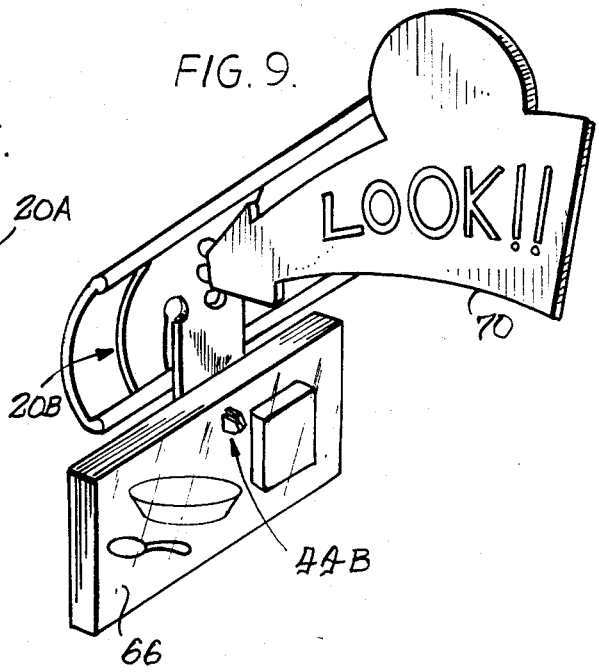
FIG. 9 is a perspective view of the hanger of FIG. 7 shown supporting a plurality of coupons.
Figure 7:
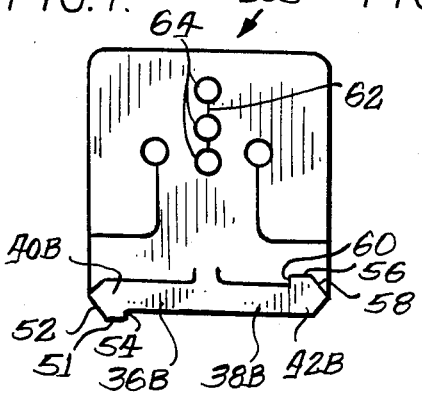
FIGS. 7 and 8 are a front elevational view and a side elevational view of another alternative embodiment of a hanger incorporating particular features of the present invention.
Figure 8:
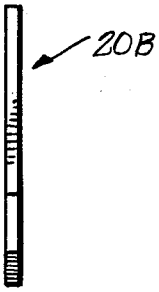

FIGS. 7 and 8 illustrate the preferred embodiment which is generally indicated by reference character 20B. Components of hanger 20B corresponding to components of hanger 20 are indicated by the reference numeral assigned to the component of hanger 20 with the addition of the suffix "B". The structure of hanger 20B is also substantially identical to that of hanger 20 except that the distal ends 40B, 42B of arms 36B, 38B do not have full arrowheads. Instead left end 40B has a downwardly extending barb-like projection 51 having an outwardly facing ramp surface 52 and an inwardly facing abutment surface 54. Similarly, right distal end 42B is provided with an upwardly extending barb-like projection 56 having an outwardly facing ramp surface 58 and an inwardly facing abutment surface 60. Additionally, the hanger of the present invention may have a slit 62 extending in the head portion and stem 30 and provided with three spaced stress-reducing apertures 64 for receiving and frictionally holding the corner of a card 70 bearing indicia for calling attention to the presence of the items to be distributed, as shown in FIG. 9.

Figure 10:
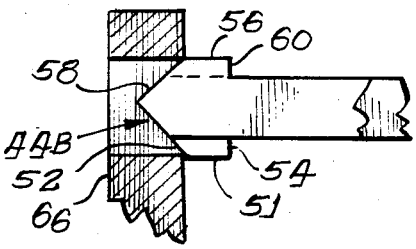
FIG. 10 is a fragmentary sectional view, enlarged in size showing the installation of coupons onto the hanger in FIG. 9.

Hanger 20B has particular advantages with items having a mounting hole with a diameter less than the distance between projections 50, 56 when arms 36B, 38B are together without overlapping of one arm with the projection of the other arm (similar to the relative positioning of arms 36, 38 in FIG. 3), but greater or equal to the distance between projections 50, 56 when arms 36B, 38B are together with arms and corresponding projections overlapping. The operation of hanger 20B is similar to that described with respect to hanger 20 except that when the aligned items are moved onto shaft 44B (as shown in FIG. 10), ramp surface 52 is engaged causing arm 36B to be cammed upwardly. Similarly, ramp surface 58 is engaged causing arm 38B to be cammed downwardly. This relative movement between arms 36B and 38B reduces the distance between projections 50 and 56 allowing mounting of the items without substantial interference from the projections. Thus coupons 66 can be easily mounted without the formation of tears at the coupon mounting holes. Once the last item passes the projections the arms, due to their resiliency, return to their non-overlapping positions. Furthermore, the arms tend to spread in a horizontal plane. Both of these actions increase the distance between the projections so that abutment surfaces 54, 60 will engage to last-mounted item upon attempted retrograde movement thereof to securely mount the items on channel 22.

In view of the above, it will be seen that the several objects of the invention are achieved and other advantageous results attained.

As various changes could be made in the above constructions without departing from the scope of the invention, it is intended that all matter contained in the above description shall be interpreted as illustrative and not in a limiting sense.

What is claimed is:

1. A hanger for supporting a plurality of generally flat items such as a pad of coupons, each having a mounting hole, to be removed one at a time, said hanger being integral and formed from a generally flat resilient blank made of an organic polymeric resin, said hanger comprising:

a head portion for mounting on a support structure;

a lower portion for carrying said items; and a stem interconnecting said head portion and said lower portion, said lower portion comprising a pair of oppositely, substantially horizontally, extending arms having adjacent connected ends and remote distal ends, said arms being deflectable from the plane of said blank together side by side to form a shaft, extending substantially perpendicularly to the plane of said blank, for projecting through the mounting holes in said items, the distal end of each arm having one oppositely extending barb-like projection for retaining said items on said shaft, the projection on one arm extending upwardly and the projection on the other arm extending downwardly, each of said arms being independently resiliently deflectable in a vertical plane when said arms form said shaft, said arms being relatively movable from a first position wherein said projections do not substantially horizontally overlap said arms to a second position wherein said projections do substantially horizontally overlap said arms, said arms being resiliently biased to said first position, whereby the effective height of the distal end of said shaft can be varied without substantial deformation of said projections.

2. A hanger as set forth in claim 1 wherein said blank is symmetrical about a plane intersecting said hanger and extending between said arms.

3. A hanger as set forth in claim 1 wherein said support structure comprises an elongate horizontally extending mounting channel having upper and lower flanges, said head portion comprising a pair of spaced dependent legs for engaging said lower flange.

4. A hanger as set forth in claim 3 wherein said dependent legs flank said stem with the upper end of each leg having a junction with said stem, said hanger comprising an aperture at each junction to avoid the formation of localized stress concentrations.

5. A hanger as set forth in claim 1 wherein said stem has a slit for receiving a portion of a card extending from said hanger to draw attention to the presence of said items.

6. A hanger as set forth in claim 1 wherein the diameter of each mounting hole is less than the distance between said projections when said arms together without overlapping of one arm with the projection of the other arm, but greater or equal to the distance between said projections when said arms are together with one arm overlapping the projection on the other arm whereby upon bring said arms together and aligning said mounting holes with the shaft formed by the arms, movement of said items toward said shaft causes relative movement of said arms allowing mounting of said items without substantial interference from said projections.

7. A hanger as set forth in claim 1 wherein each projection has an outwardly facing ramp surface and an inwardly facing abutment surface.

* * * * *